United States Patent [19]

Landa

[11] 4,351,617

[45] Sep. 28, 1982

[54] MICROBALLISTIC PRINTER

[75] Inventor: Benzion Landa, Edmonton, Canada

[73] Assignee: Savin Corporation, Valhalla, N.Y.

[21] Appl. No.: 239,891

[22] Filed: Mar. 3, 1981

Related U.S. Application Data

[63] Continuation of Ser. No. 39,372, May 5, 1979, abandoned.

[51] Int. Cl.[3] ..... B41J 3/02

[52] U.S. Cl. ..... 400/118; 400/17; 400/121

[58] Field of Search ..... 400/16, 17, 118, 119, 400/121, 126; 101/114; 340/764, 783, 788; 346/141; 51/310, 319, 320, 424; 72/53

[56] References Cited

U.S. PATENT DOCUMENTS

| | | | |
|---|---|---|---|
| 2,034,308 | 3/1936 | Morgan | 51/310 X |
| 2,837,076 | 6/1958 | Koci et al. | 124/51 R X |
| 3,232,221 | 2/1966 | Stowell | 346/141 |
| 3,261,021 | 7/1966 | Kirchner | 346/1.1 |
| 3,269,066 | 8/1966 | Straub | 51/319 |
| 3,545,996 | 12/1970 | Duncan | 51/310 X |
| 3,624,966 | 12/1971 | Palmer | 51/310 X |
| 4,046,131 | 9/1977 | Clark et al. | 124/51 R X |
| 4,094,294 | 6/1978 | Speer | 124/51 R X |
| 4,149,807 | 4/1979 | Avison et al. | 400/118 |
| 4,150,902 | 4/1979 | Brescia | 400/126 X |

FOREIGN PATENT DOCUMENTS

| | | | |
|---|---|---|---|
| 2856581 | 7/1979 | Fed. Rep. of Germany | 400/119 |

*Primary Examiner*—Paul T. Sewell
*Attorney, Agent, or Firm*—Shenier & O'Connor

[57] ABSTRACT

My invention comprises a ballistic impact printer which includes a gun for successively propelling balls along predetermined paths to trace a desired character on a medium supported on a platen spaced from the gun. Means are provided for orienting the gun after each ball leaves the muzzle of the gun so that the desired pattern is formed. Gas under pressure propels a ball along the bore of the gun, which is slightly larger than the diameter of the ball. This enables me to make the gun out of resilient material, since a gas bearing is formed which prevents a ball from touching the sides of the bore while it is traveling down the bore. The breech of the gun is slightly smaller than the diameter of a ball, so that a ball acts as a seal for a chamber in which gas pressure is being built up. When a ball in the breech is dislodged by a succeeding ball, gas from the chamber performs its propelling action between the time the ball is dislodged from the breech and the succeeding ball is seated in the breech. Balls rebounding from the platen are continuously recycled.

18 Claims, 10 Drawing Figures

MICROBALLISTIC PRINTER

This is a continuation of application Ser. No. 039,372, filed May 5, 1979, now abandoned.

BACKGROUND OF THE INVENTION

There are known in the prior art various high-speed printing devices which print by applying to the medium to be printed a plurality of dots of printing material in the configuration of one or more characters to be applied to the medium. One of the most common types of such high-speed printers is a matrix printer using a plurality of reciprocating wires which are driven in an axial direction to impinge on a carbon ribbon or the like in front of paper so as to produce a dot pattern on the paper. Such printers embody a number of disadvantages. First, the wires must be recocked after each operation and the time taken to perform the recocking is lost time. Secondly, for reasonable resolution the wire diameter must be kept small and the wires themselves must be supported near the paper surface. Individual bearings for the wires result in a fixed X, Y position for each wire. With such a printer, it is not possible to produce overlapping dots without moving the printing head relative to the medium. The system thus inherently is limited as to the quality of character which can be produced thereby without such relative motion. In addition, owing to the fact that each of the individual wires has its own bearing, the device is relatively large and is expensive.

Another type of high-speed printer known in the prior art is the so-called "ink-jet" printer in which jets of ink are propelled onto the printing medium. These printers likewise incorporate a number of disadvantages. Owing to the fact that one cannot accurately propel a drop of liquid over an appreciable distance, the size of the character which can be produced is limited. In addition, the flight path of the jet is sensitive to ambient air currents. Problems of splattering and splashing also are present. Thus, the quality of the characters produced by such a system varies widely. A major disadvantages of an ink-jet printer is that it cannot make carbon copies.

FIELD OF THE INVENTION

My invention relates to a microballistic printer and more particularly to a high-speed printer in which a plurality of solid projectiles are propelled in free flight across the space from a source to the medium to be printed and in which the flight paths thereof are so controlled as to produce an impact on the medium in the pattern of the printing desired to be applied thereto.

SUMMARY OF THE INVENTION

In general, my invention contemplates the provision of a microballistic printer in which the flight paths of a plurality of solid projectiles propelled from a gun for free flight across a space between the gun and the medium to be printed are so controlled that the projectiles produce an impact on the medium in the desired printing pattern. I collect the projectiles which have rebounded after impact and return them to the gun supply.

OBJECT OF THE INVENTION

One object of my invention is to provide a microballistic printer which overcomes the defects of high-speed printers of the prior art.

Another object of my invention is to provide a microballistic printer which consistently produces high quality characters.

Still another object of my invention is to provide a microballistic printer which is relatively small for the printing area covered thereby in a single printing operation.

Still another object of my invention is to provide a microballistic printer which is not susceptible to disruption by ambient air currents.

Yet another object of my invention is to provide a microballistic printer which is relatively inexpensive to construct for the result achieved thereby.

A further object of my invention is to provide an impact printer capable of making carbon copies.

Still another object of my invention is to provide a printer which will print characters or figures of any description.

Other and further objects of my invention will appear from the following description.

BRIEF DESCRIPTION OF THE DRAWINGS

In the accompanying drawings which form part of the instant specification and which are to be read in conjunction therewith and in which like reference characters are used to indicate like parts in the various views:

FIG. 7 is a fragmentary sectional view of my microballistic printer taken along the lines 7—7 of FIG. 5 and drawn on an enlarged scale.

FIG. 8 is a sectional view of the gun assembly of my microballistic printer drawn on a greatly enlarged scale.

DESCRIPTION OF THE PREFERRED EMBODIMENT

Figure 1:
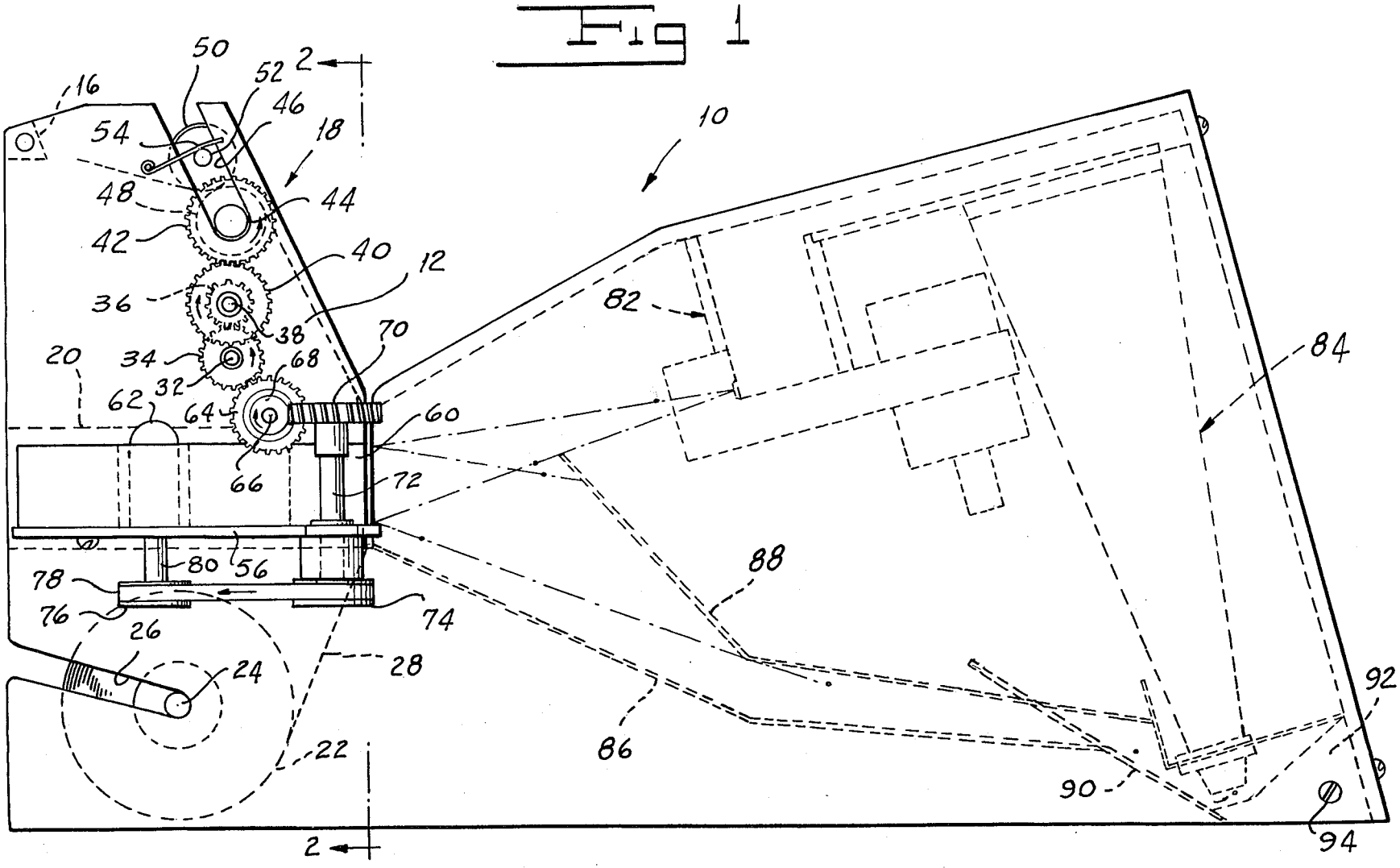
FIG. 1 is a side elevation of one form of my microballistic printer.
Figure 2:
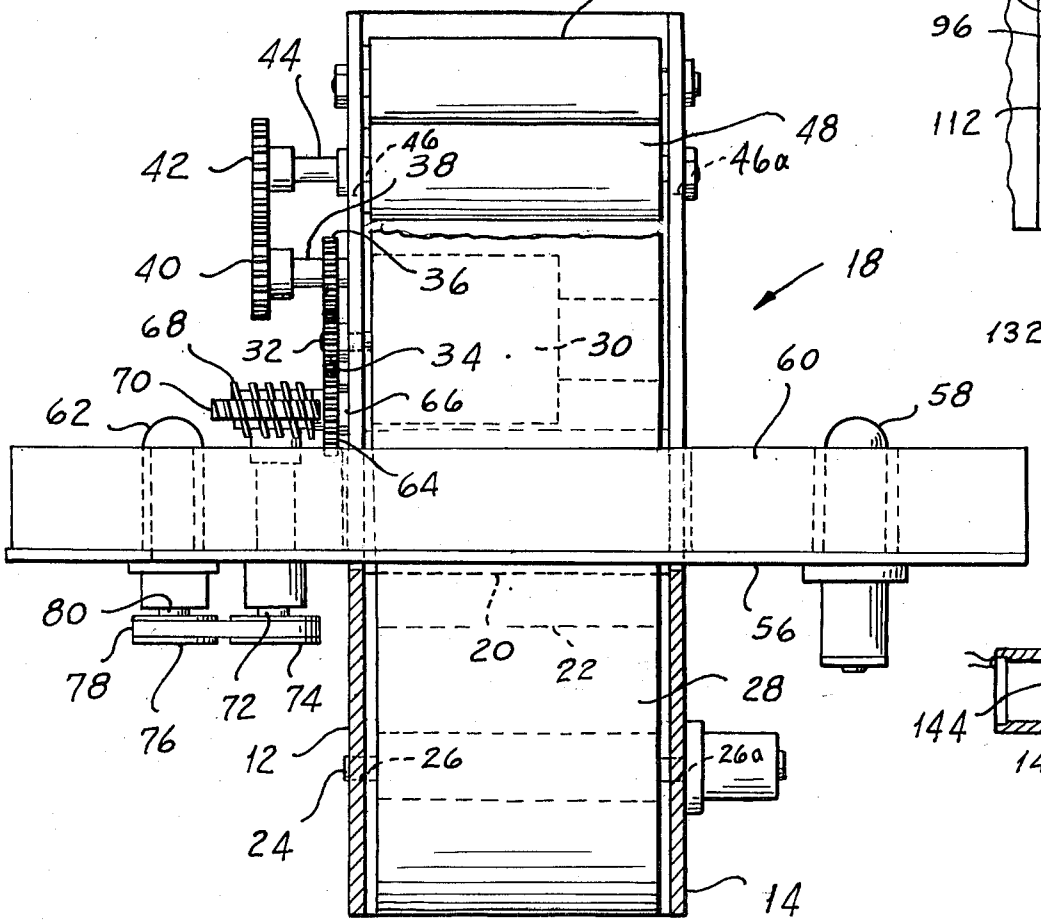
FIG. 2 is a sectional view of the form of my microballistic printer illustrated in FIG. 1 and taken along the lines 2—2 thereof.

Referring now to FIGS. 1 and 2 of the drawings, my printer indicated generally by the reference character 10, includes respective sidewalls 12 and 14 connected at the upper front end thereof by a crosspiece 16 secured to the walls by any suitable means. The paper and carbon ribbon section, indicated generally by the reference character 18 of my printer, includes a platen 20 secured between sidewalls 12 and 14 by any appropriate means and formed of any suitable material, such for example as Plexiglas, which is the registered trademark of Rohm and Haas Co. of Philadelphia, Pa., for an acrylic resin. A paper supply roll 22 is supported by a shaft 24 the ends of which are received in slots 26 and 26*a* formed in the respective walls 12 and 14. Paper 28 is adapted to be drawn from the roll 22 in a manner to be described.

A motor 30 is adapted to be energized periodically to rotate its shaft 32 which carries a gear 34 which meshes with a gear 36 to drive a shaft 38 supported on wall 12. Shaft 38 carries a second gear 40 which drives a gear 42 carried by a shaft 44 slideably received in slots 46 and 46*a* formed in the upper portions of walls 12 and 14. Shaft 44 carries the paper feed roll 48 over which the paper 28 from the roll 22 passes. A press roll 50 has a shaft 52 the ends of which extend into the slots 46 and 46*a*. One or more springs 54 carried by the walls 12 and 14 act on the ends of shaft 52 to urge the press roll 50 toward the paper feed roll 48 so as to clamp the paper between the press roll and the feed roll.

A bracket 56 extends across the unit 18 and for a distance outboard of each of the sidewalls 12 and 14. The portion of the bracket 56 extending laterally outwardly from wall 14 carries a spindle 58 which supports a supply roll 60 of carbon ribbon of any suitable type known to the art. The ribbon 60 extends across the platen 20 in front of the paper 28 to a takeup roll spindle 62.

Gear 34 carried by the shaft 32 of motor 30 also drives a gear 64 supported on a shaft 66 carried by the wall 12. A worm 68 on the shaft 66 drives a worm wheel 70 on a shaft 72 rotatably supported by any suitable means on the bracket 56. Shaft 72 carries a pulley 74 coupled by a belt 78 to a pulley 76 carried by a shaft 80 adapted to drive the spindle 62.

From the structure just described, it will readily be appreciated that motor 30 may be energized as necessary to advance the paper 28 and the ribbon 60 to position a fresh area of paper and a fresh area of ribbon over the printing region on the face of platen 20 after each predetermined portion of the printing operation has been completed.

My microballistic printer 10 includes a projectile propelling section, indicated generally by the reference character 82, to which balls are fed in a manner to be described by a ball return device indicated generally by the reference character 84. Balls are projected from the assembly 82 toward the platen 20 along paths such as those which are indicated in dot-dash lines in FIG. 1. Balls which rebound from the portion of the ribbon 60 extending across the platen are collected between a lower guide 86 and an upper guide 88 and directed toward a region, at the lower end of device 84, formed by a guide plate 90 and by the upper surface of a cross brace 92 secured between the walls 12 and 14 by any suitable means, such for example as by screws 94 or the like.

Figure 4:
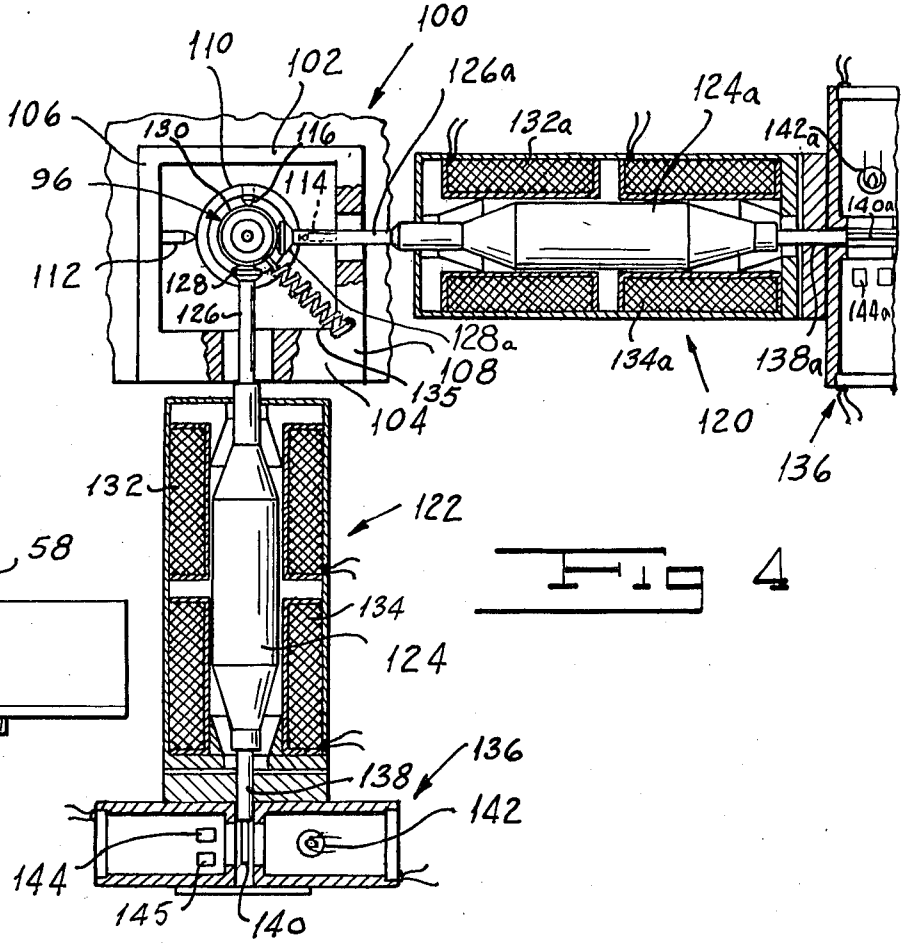
FIG. 4 is a fragmentary front elevation of the projectile propelling section of my microballistic printer viewed along the line 4—4 of FIG. 3 and drawn on enlarged scale with parts broken away and with other parts shown in section.
Figure 3:
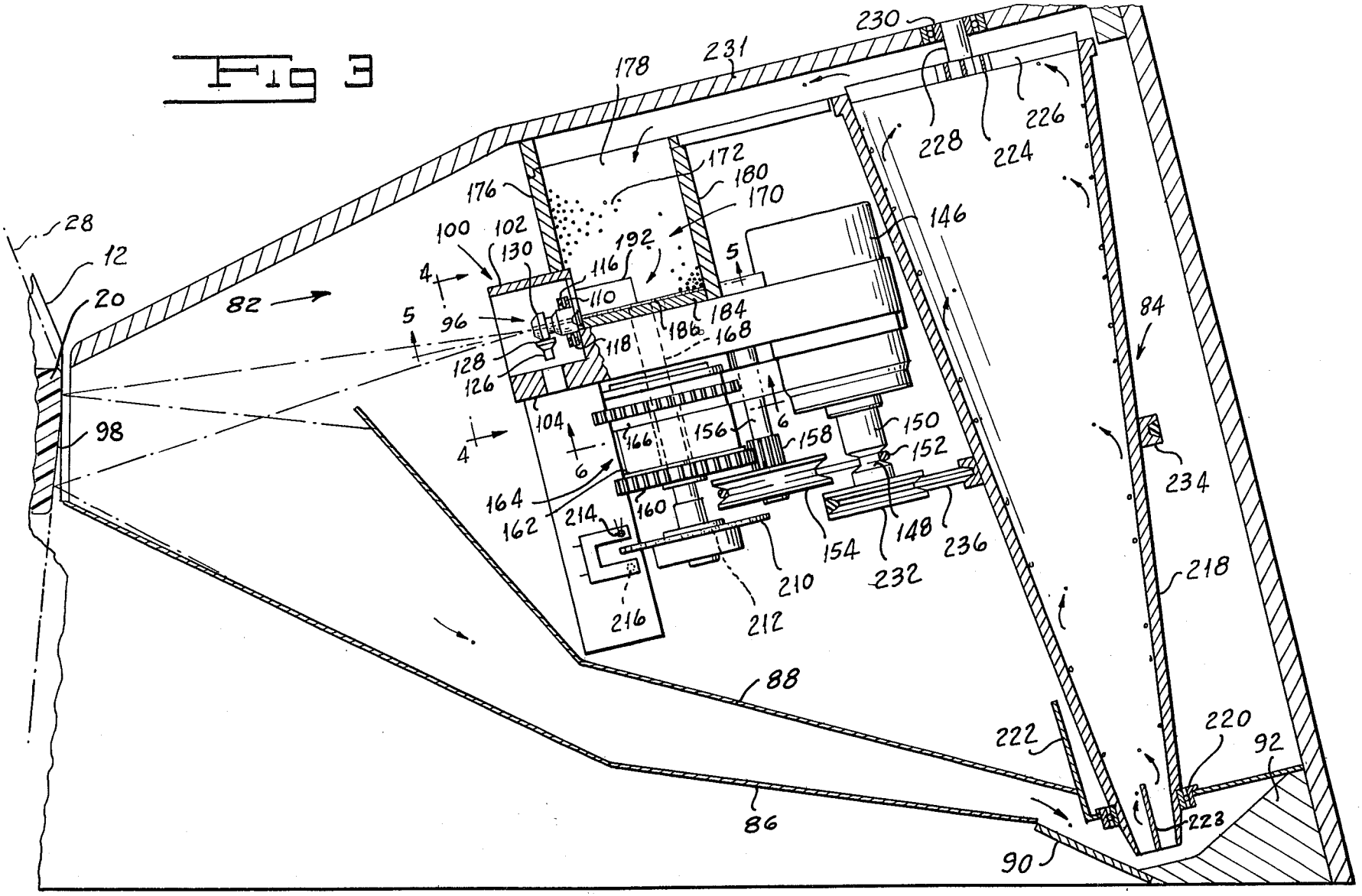
FIG. 3 is an enlarged side elevation with parts shown in section and with other parts broken away of the projectile propelling section of my microballistic printer.
Figure 5:
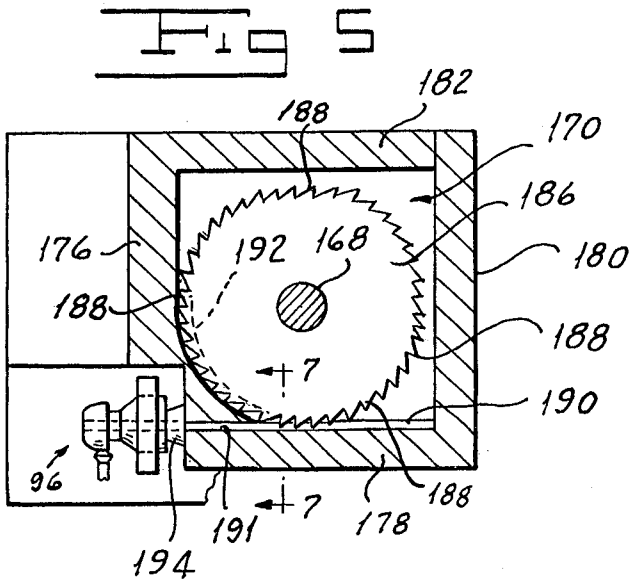
FIG. 5 is a sectional view of a portion of my microballistic printer drawn on an enlarged scale taken along the lines 5—5 of FIG. 3.

Referring now to FIGS. 3 and 4, the gun assembly, indicated generally by the reference character 96, is adapted to direct projectiles such as balls toward the surface 98 of the platen 20 which is disposed behind the paper 28. It is to be noted that surface 98 is not flat but is of a very large radius so that the paper is in contact with the surface throughout the whole height of the part of the platen which is used in the course of the printing operation. As has been pointed out hereinabove, Plexiglas is one form of material which is suitable for making the platen 20. That is, platen 20 must be hard enough to act as an anvil, and yet it must be sufficiently soft so that impact of the balls thereon will not chip or damage the surface. While any one of a large number of materials are suitable for forming the platen, I have discovered that Plexiglas is one material which is particularly appropriate for formation of the platen.

The gun assembly 96 may be disposed, for example, in a housing indicated generally by the reference character 100 having a top 102, a bottom 104, and sidewalls 106 and 108. A gimbal ring 110 is supported by a pair of axially aligned pivot pins 112 and 114 carried by the respective sidewalls 106 and 108. The pivot pins 112 and 114 support the gun assembly 96 for movement about one axis which lies in a plane generally parallel to the plane of the paper 28 and which may be said to be, for example, the "X" axis.

Ring 110 carries a pair of axially aligned pivot pins 116 and 118 which support the gun assembly 96 for movement around an axis which is generally perpendicular to the axis of pins 112 and 114 and which may be considered the "Y" axis.

I provide my microballistic printer with a Y-deflection drive system, indicated generally by the reference character 122, for pivoting the assembly around the X axis, and with an X-deflection drive system, indicated generally by the reference character 120, for pivoting the assembly around the Y axis. Since the two drive systems are of substantially the same construction, only one of the systems will be described in detail. The Y-deflection drive system 122, for example, includes a generally cylindrical iron armature 124 adapted to move along an axis which is generally parallel to the Y axis of the system. The armature 124 carries a rod 126 formed with a head 128 adapted to engage a cam surface 130 of the gun assembly at a location in front of the Y axis pivot pins 116 and 118 so as to cause the assembly 96 to move around the X axis of pins 112 and 114. Similarly, the X-deflection drive system 120 includes a head 128*a* adapted to engage the surface 130 at a location in front of the X axis pivot pins 112 and 114 so as to cause the gun assembly 96 to pivot around the Y axis defined by pins 116 and 118. As will be explained more fully hereinbelow, the surface 130 is so shaped as to provide the correct correspondence between linear motion of the driver rods 126 and 126*a* and the angular displacement of the gun barrel.

Each of the drives 120 and 122 includes a pair of windings 132 and 134 and 132*a* and 134*a*, adapted to be supplied with current in a manner to be described so as to provide electromagnetic fields which act on the armatures 124 and 124*a* in opposite directions. It will readily be apparent that whichever winding exerts the greater force on the armature 124 or 124*a* will determine the direction in which the armature is moved from its neutral position. A tension spring 135, indicated schematically in FIG. 4, is connected between the gun 96 and the housing 100 so as to ensure that the surface 130 always is in engagement with the surfaces of the heads 128 and 128*a*.

Figure 9:
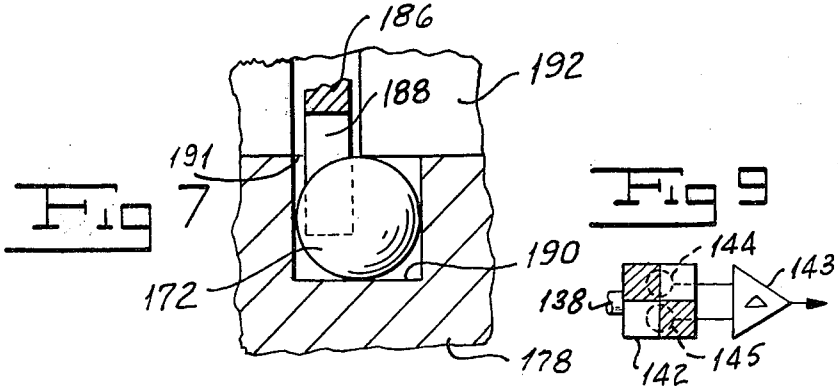
FIG. 9 is a schematic view illustrating one form of positioned feedback signal generating device which I may employ with my microballistic printer.
Figure 5:
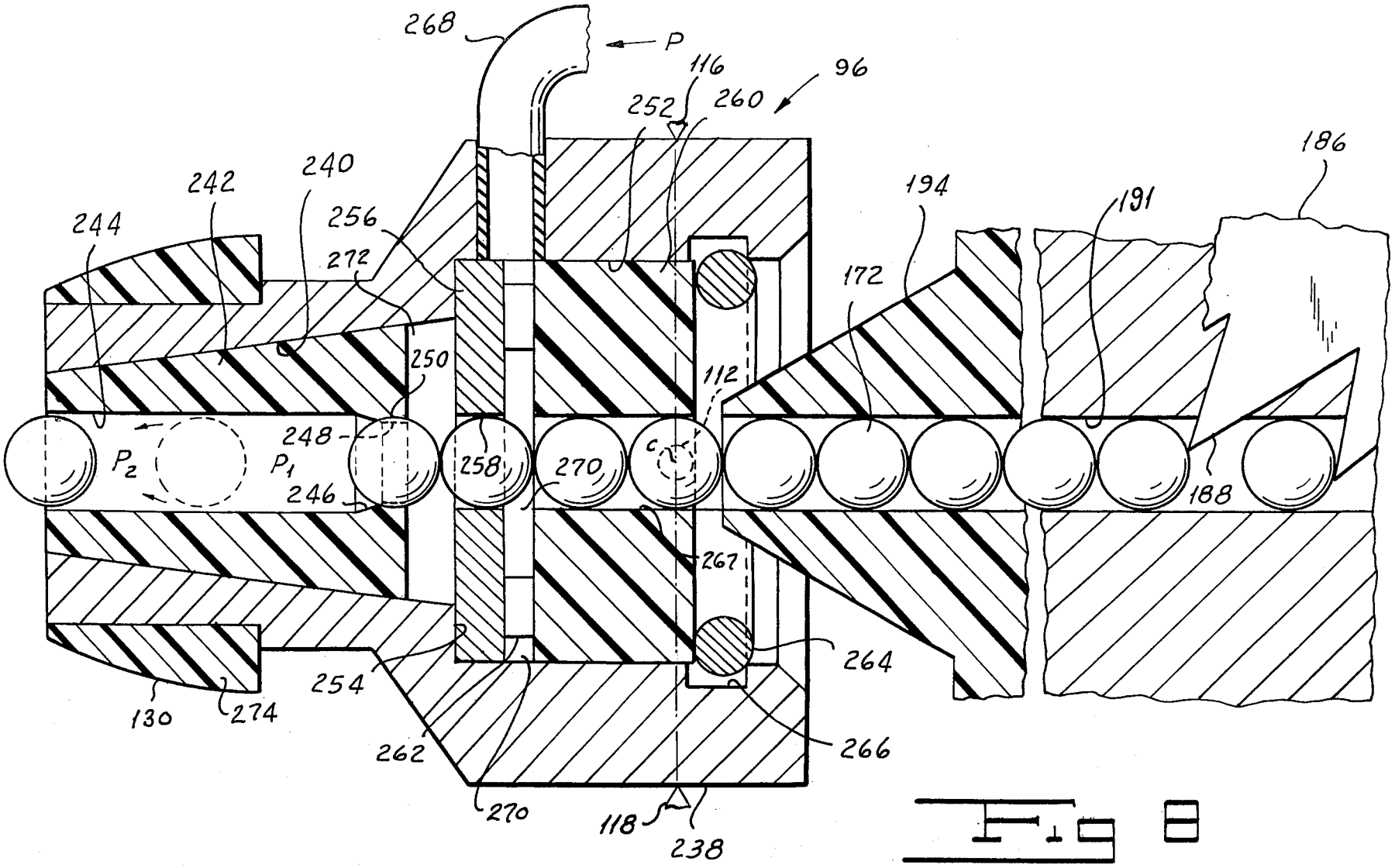

Referring to FIGS. 4 and 9, each of the drive systems 120 and 122 includes a feedback arrangement for providing an indication of the position presently occupied by the associated head 128. For example, the position detector, indicated generally by the reference character 136 of the Y-deflection drive system includes a screen 140 carried by a rod 138, secured to armature 124 for movement therewith. This screen 140 includes four quadrants which are alternatively opaque and transparent. Light from a source 142 is adapted to pass through the transparent quadrants of the screen 140 to respective photo detectors 144 and 145, each one of which is associated with a pair of quadrants including an opaque quadrant and a transparent quadrant. Signal outputs from the detectors 144 and 145 may be fed to a differential amplifier 143 to provide a signal indicating the absolute position of the corresponding head 128.

Referring now to FIGS. 3 and 5 to 7, a motor 146 is adapted to be energized to drive a first pulley member 148 formed in the shaft 150 of the motor. A belt 152 connects pulley portion 148 to a pulley 154 carried by an idler shaft 156 supported on the machine frame. Shaft 156 carries a pinion 158 which meshes with a gear 160 carried by the input element 162 of a slip clutch indicated generally by the reference character 164. Clutch 164 which may be of any suitable type known to the art includes an output element 166 carried by a shaft 168 for rotation therewith. Further as is known in the art, so long as the output member 166 is restrained against rotary movement, the input member 162 will rotate relative thereto. However, when the member 166 is free to rotate clutch 164 clutches the elements 162 and 166 so that shaft 168 is driven by shaft 150.

My microballistic printer includes the ball storage bin indicated generally by the reference character 170 including walls 176, 178, 180 and 182, and a bottom 184, adapted to store a quantity of balls 172. I form balls 172 of any suitable material such for example as tungsten carbide. Shaft 168 carries for rotation therewith a projectile or ball feeding element in the form of a saw blade 186 having a plurality of teeth 188. Balls 172 returned to the bin 170 in a manner to be described hereinbelow fall down onto the bottom 184 and into a groove 190 formed in the wall 178. As the shaft 168 rotates, teeth 188 move into the channel 190 to carry the balls 172 along the channel and through an outlet passage 191 to an outlet guide 194 leading to the gun 96. In order to permit the balls 172 to be fed rapidly to the gun assembly 96, and for the ready release of the balls 172 from the spaces between the teeth 188 of the blade 186, I make the blade 186 about half the thickness of a ball 172. At the point at which the ball 172 leaves the slot 190 and enters passage 191, a guide 192 on wall 176 forms a slot through which the blade teeth pass as they move upwardly out of the channel 190. This guide 192 facilitates separation of the balls 172 from the saw blade.

I provide my printer with means for releasing clutch element 166 for a period of time sufficient to cause blade 186 to move a number of balls 172 into the passage 191 equal to the number of balls which are required to carry out a program or sub-program in the course of formation of a character or the like. Shaft 168 carries for rotation therewith a stepping wheel 196 having a plurality of teeth 198 corresponding in number to the number of teeth on the saw blade 186. A detent arm 200 formed of ferromagnetic material carries a detent 202 which normally is in engagement with one of the teeth 198 to prevent rotation of wheel 196 and shaft 168. A spring 206 normally urges the arm 200 to rotate around a pivot 204 to position the detent 202 in engagement with one of the teeth 198. An electromagnet 208 is adapted to be energized to act on arm 200 to move the arm against the action of spring 206 to a position at which detent 202 is out of engagement with the teeth 198 on wheel 196. When shaft 168 has rotated for a period of time sufficient to feed a number of balls required by a routine or subroutine in the course of making up a character, electromagnet 208 is de-energized to permit detent 202 to move back to its initial position to engage a tooth 198 to stop shaft 168.

Shaft 168 also carries for rotation therewith a counter disc 210 provided with a plurality of holes 212 corresponding in number to the number of teeth 188 on wheel 186. A portion of disc 210 carrying the holes 212 is adapted to move through the space between a source of illumination 214 and a photodetector 216 to cause the photodetector to put out a signal each time a ball is fed into the passage 191 by the blade 186. Thus, photodetector 216 puts out a digital signal indicating the number of balls which are fed during the period of time for which the electromagnet 208 is energized.

My microballistic printer includes a "cyclone" ball return system 84 including a hollow conical member 218 supported for rotary movement in a bearing 220 carried by a bracket 222 on the machine frame. The lower open end of the member 218 is disposed in the space formed by plate 90 and crosspiece 92 to which balls bouncing off the platen are returned by guides 86 and 88. I provide the lower end of member 218 with a crosspiece 223 which assists the balls in entering the member 218 and moving upwardly along the inner wall thereof when the member 218 rotates in a manner to be described. I secure a cap 224 formed with a plurality of radially extending circumferentially spaced arms 226 in the upper end of member 218. A shaft 228 on the member 224 is rotatably received in a bearing 230 supported on the cover plate 231 on the gun portion of my microballistic printer. A pulley 232 carried by shaft 150 for rotation therewith is connected by a belt 236 to a pulley 234 formed on the outside of member 218, so that as motor 146 is driven to spin the member 218 about its axis, balls from the return space adjacent to the bottom of member 218 enter the member and under the action of centrifugal force travel upwardly along the inner surface and through the space between arms 226 which hurl the balls along a passage leading to the bin 170.

Referring now to FIG. 8, the subassembly 96 includes a body 238 formed of any suitable material, such for example as aluminum and having a conical bore portion 240 which receives the gun 242 which may be formed of any suitable material known to the art. One material which I have found to be eminently suited for making the gun proper is Celcon, which is the registered trademark of Celanese Corporation of America, for an ethylcellulose thermoplastic having a high impact strength at very low temperatures. The gun 242 has an outer conical surface conforming to the conical bore 240 so that the gun is self locating in the housing or body 238. Gun 242 is formed with an inner cylindrical bore 244 of a diameter which is slightly greater than that of the balls 172. Bore 244 extends from the front of the gun rearwardly toward a tapered portion 246 leading into a cylindrical sphincter or breech 250, having an opening 248 of smaller diameter than the bore 244. It will readily be appreciated that the sphincter 250 which is about 0.1 mm thick could be provided by a separate element of any suitable material. It provides an interference fit with a ball. A recess 252 in the body 238 behind the conical bore 240 receives a loading guide 256 which bears against a shoulder 254 at the juncture between bore portion 240 and recess 252. I form the wall guide 256 from any suitable material, such for example as steel having a Rockwell hardness of A 60, for example. Guide 256 has a central opening 258 of a diameter which is slightly greater than that of a ball 172. I position a pressure seal member 260 within recess 252 behind guide 256 and spaced therefrom by spacers 262. A spring clip 264 disposed in an annular recess 266 holds the pressure seal in position. The seal 260 may be formed of any suitable material known to the art. One material which I have found to be suitable for use in making the seal 260 is Delrin, which is the registered trademark of E. I. DuPont de Nemours and Company of Wilmington, Delaware, for an aceytl resin for molding articles having the characteristics of high strength and stiffness combined with toughness and resilience over a wide temperature range, good dimensional stability in the presence of moisture, high heat distortion temperature, excellent resistance to all types of organic solvents, excellent bearing characteristics and good abrasion resistance. I form the seal 260 with a central passage 267 having a diameter substantially equal to the diameter of a ball 172, which passage 267 leads from the outlet of guide 194 and is aligned with the opening 258 in guide 256. An air inlet 268 admits air through the wall of body 238 to the antechamber 270 between guide 156 and seal 260. The arrangement of my gun assembly is such that the rear of gun 242 is spaced from guide 256 to form a pressure chamber 272 the function of which will be described more fully hereinbelow.

I assemble a designator cam 274 of the assembly 96 on a reduced forward end portion of the main body 238 of the gun. Cam 274 may be made from any suitable material such for example as Delrin. It is so formed as to provide the surface contour 130 on which the actuator heads 128 and **128*a*** ride.

It will be seen that the intersection of the axis of pivot pins 112 and 114 with the axis of pivot pins 116 and 118 is located at the center "C" of the last ball in seal 260 and it is this point "C" around which the assembly 96 pivots to aim the gun 242 for each ball 172 fired from the gun in the manner described hereinbelow.

Figure 10:
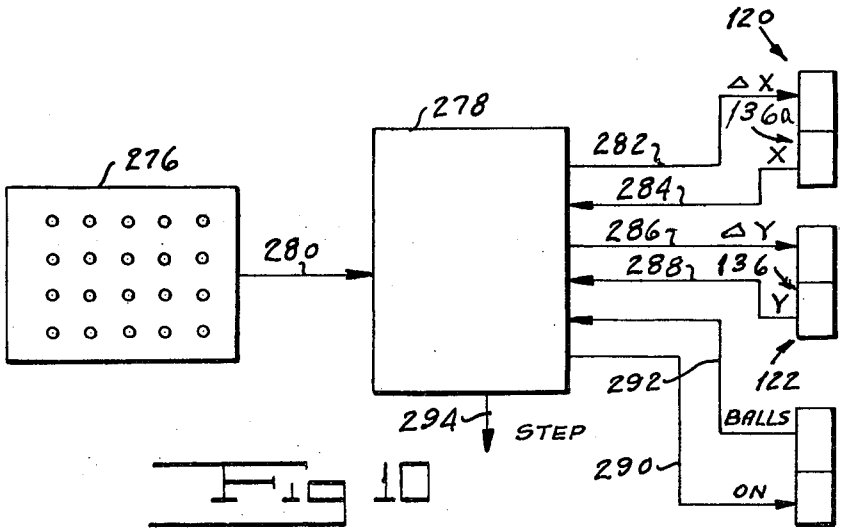
FIG. 10 is a diagrammatic view of one form of control system which may be employed with my microballistic printer.
Figure 6:
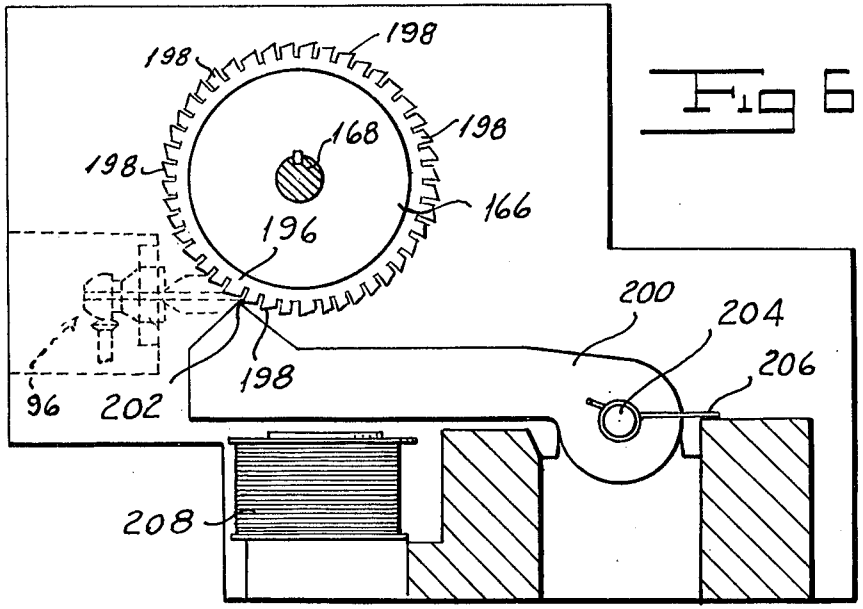
FIG. 6 is a sectional view of my microballistic printer drawn on an enlarged scale taken along the lines 6—6 of FIG. 3.

Referring to FIG. 10, which illustrates schematically one form of control system for my microballistic printer, input information to the system may be from any suitable source, such for example as a keyboard 276, the keys of which are actuated to feed input information to a computer 278 on a channel 280. Computer 278 puts out information in the form of programs and sub-programs including X command information on a channel 282 to the X actuating unit 120. Feedback information from unit 120 is carried by a channel 284 back to computer 278. Y command information is fed from computer 278 to unit 122 along a channel 286, while the unit 122 provides feedback information on a channel 288. A computer output channel 290 is adapted to energize electromagnet 208 to provide for feeding of balls 172 of a number sufficient to perform the commanded program or sub-program. Feedback information from detector 216 is received by computer 278 from a channel 292. At the end of a program or sub-program, computer 278 puts out a stepping signal on a channel 294 to energize motor 30 to position fresh paper and fresh carbon ribbon in front of the platen 20.

In operation of my microballistic printer, if the apparatus is in the quiescent state blade 186 will have advanced balls to such a position that the leading ball engages the sphincter region 250 so as to form a seal therewith to permit the pressure buildup in pressure chamber 272. From the leading ball counting rearwardly three balls, there will be a ball 172 which is positioned at the rear of seal 260 and which is in engagement with the ball 172 about to emerge from the guide 194. As has been pointed out hereinabove, the gun assembly 96 is supplied for universal pivotal movement about the center C of this last ball in the seal 260. In one embodiment of my microballistic printer the length of the gun barrel may be 3 mm. Balls 172 may be, for example, 0.8 mm diameter so as to produce a spot size on the paper of 0.3 mm diameter. The sphincter portion 250 has an opening 248 of a diameter which is slightly less than the diameter of the ball. For example, the diameter of opening 248 might be 0.77 to 0.799 mm, while the balls are accurately of a diameter of 0.800000. With a ball 172 in the opening 248, fluid such as air under a pressure P of 4 to 6 atmospheres is conducted into the antechamber 270 through the tube 268. The diameter of opening 258 in plate 256 may be slightly greater than that of the balls by, for example, 0.01 mm. In my printer, the compressed volume of air in the pressure chamber 272 is slightly greater than the decompressed volume of air in the gun bore 244, so that the pressure buildup P1 in chamber 272 can expand to a reduced pressure P2 in the gun barrel 244 when the ball lodged in the sphincter opening 248 is released in a manner to be described. Stated in another way, the volume of the gun barrel 244 at atmospheric pressure contains about the same number of molecules of gas as does the pressure chamber 272 at its higher pressure. That is, the relationship between the chamber 272 and the bore 244 is such that a predetermined quantity of air at a known pressure and volume is provided as will eject the ball from the muzzle of the bore at the required velocity.

When the computer 278 dictates that a printing operation is to begin, a signal appears on channel 290 to start motor 146 to cause blade 186 to begin feeding balls. As the blade rotates, the force of a tooth thereof is exerted on the line of balls between the ball and the sphincter and the last ball being acted on by the tooth so as to dislodge the ball from the sphincter and permit the pressure P1 in the pressure chamber 272 to expand into the barrel 244. As soon as a ball in the sphincter is released, a slug of air from the chamber 272 enters bore 244 so that the ball in effect has atmospheric pressure in front of it and has a higher pressure behind. It starts to move along the bore and the relatively higher pressure air escapes at a higher velocity through the space between the periphery of the ball and the wall of the bore 244. This has the effect of providing an air bearing which prevents the ball from touching the wall of the bore as it moves therealong toward the exit thereof. It can be said that the air pressure integrates the cross-sectional shape of the bore. Since the ball 172 never touches the wall of the bore 244 the range of materials from which the gun can be made is relatively wide.

It will be seen if the velocity of the air escaping around the ball at one location decreases, the velocity on the other side would tend to increase, thus drawing the ball back to the center of the bore. By the time the ball reaches the muzzle of the gun barrel, it is traveling at a speed of from about 20 to about 40 meters per second. At the time the computer commanded the gun to begin firing, the computer puts out command signals on lines 282 and 286 to aim the gun so that the first ball would arrive at the desired location on the platen 20.

After the first ball has been fired, the next ball moves into position in opening 248 to form a seal therewith and the pressure in the chamber 272 again builds up to a value equal to the pressure P. The antechamber 270 is necessary because the process is a dynamic one. That is, as one ball is ejected by the previous ball, there is an influx of air into the antechamber which might affect the path of the ball just being ejected. The antechamber prevents such a result and permits the next ball to be seated in opening 248 before any appreciable pressure buildup begins. As the first ball moves out the sphincter, sensor 216 produces a feedback signal indicating that the first ball has been fired and that the gun should be reoriented by new signals on channels 282 and 286, so that the next ball will arrive at the desired location over the surface of the platen 20. It will be remembered that channels 284 and 288 provide feedback information indicating the position to which the gun was oriented for the first ball. The system continues in this manner until the number of balls making up the program or sub-program have been fired, at which time a new program or sub-program is begun. Preferably I provide about 60% overlap of adjacent dots. I have discovered that this results in a nearly continuous outline appearance to the ordinary observer.

It will be appreciated that while the gun assembly 96 is being pivoted about the point C under the action of the actuators 120 and 122, the rods 126 and **126*a* thereof are moving axially. That is to say, the forces exerted by the rod heads 128 and 128*a* are not continuously tangential with relation to a circle the center of which is located at C. As a result, in the absence of compensation, the same linear displacement of a head 128 or 128*a* will not always produce the same displacement of the ball along that axis in the plane of the platen. I so shape the surface 130 of the designator cam 274 so as to compensate for that fact. The surface 130 is so shaped as to provide the same displacement along the platen surface for a corresponding displacement of a head 128 or 128*a*** at all positions of the head.

It is to be noted that since I deflect my gun assembly 96 about only one point C, the only limitation on the area of the platen 20, which I may cover with one of my units, is the accuracy of the ball path over the distance from the gun muzzle to the platen. With the arrangement shown I have shot balls in very nearly absolutely straight lines over a distance of two to three feet, although in a practical machine the spacing between the gun and the platen will be much less. In a practical system I contemplate firing about 2000 balls per second. The length of the gun barrel and the ball velocity are so related as to permit one ball to be fired from the gun and to permit the gun to be addressed before the next ball is dislodged from the restricted breech 250.

From the foregoing, it will be appreciated that seal 260 not only forms a seal with the wall of recess 252 but also passage 267 is sufficiently long that one ball 272 is always in sealing relationship with the wall of the passage.

The information fed to the computer for gun positioning may be in the form of a number of subroutines from which characters can be composed. The subroutines may be vertical or horizontal lines at different angles and of different lengths and sectors of various curves at desired orientations. The complete characters to be formed are broken down into appropriate shapes and described to the computer in terms of the subroutines, a discipline which is much simpler than an individual X-Y designation for each ball.

It is to be noted that while I have shown a particular electromagnetic drive system for positioning the gun assembly and have shown a photoelectric feedback system, the functions produced by these devices can readily be performed by any other type of drive and feedback devices known to the art. It is to be noted further that, while I have shown and described only a single gun assembly, I contemplate an arrangement of a battery of guns operated in concert to produce a large area of printed matter. It will readily be understood that a single gun assembly can be bodily indexed as required to print a larger area than if the assembly were stationary. I further contemplate a vertically superposed array of guns with the lines of fire converging substantially at a point behind the platen and providing relative lateral translational movement between the platen and the array.

I further contemplate a lateral array of such vertically superposed arrays of guns with all lines of fire converging substantially at a point behind the platen and providing relative lateral motion between the platen and the array of arrays.

It will be seen that I have accomplished the objects of my invention. I have provided a microballistic impact printer which overcomes the defects of high-speed printers of the prior art. My microballistic printer consistently produces characters of high quality. My microballistic printer is relatively small for the printing area covered thereby in the course of a single printing operation. My microballistic printer is not susceptible to disruption by ambient air currents. It is relatively inexpensive to construct for the results achieved thereby.

It will be understood that certain features and subcombinations are of utility and may be employed without reference to other features and subcombinations. This is contemplated by and is within the scope of my claims. It is further obvious that various changes may be made in details within the scope of my claims without departing from the spirit of my invention. It is, therefore, to be understood that my invention is not be limited to the specific details shown and described.

Having thus described my invention, what I claim is:

1. A ballistic printer for transferring printing material from a ribbon carrying the same to a medium, a platen for supporting said medium, a gun assembly including a barrel having a muzzle and a restricted breech, means for mounting said gun assembly for pivotal movement around a point spaced from said platen, a magazine holding a supply of solid balls, means for successively feeding balls from said supply to said restricted breech, means forming a pressure chamber behind said restricted breech, means for supplying fluid under pressure to said pressure chamber, said balls having a diameter slightly greater than that of said restricted breech whereby said breech is adapted to receive and retain a ball against the action of said fluid pressure, means for concomitantly dislodging a ball from said restricted breech and inserting another ball into said restricted breech, and means for successively orienting said gun assembly toward said platen along predetermined paths after each ball has been discharged from said muzzle.

2. Apparatus for applying printing material to a medium including in combination a platen for supporting said medium, means for successively propelling a plurality of solid projectiles in free flight toward said medium from a location spaced from said medium, means for controlling the flight paths of said projectiles to impact the medium in a desired pattern, means for recycling said projectiles to said propelling means after they have struck the medium, said recycling means including a hollow rotary member having an internal surface formed along the locus of an inverted truncated cone, means for directing projectiles leaving said medium to the truncated end of said internal surface, and means for rotating said rotary member to impel the projectiles upwardly under the action of centrifugal force toward the base end of said internal surface.

3. Apparatus for applying printing material to a medium including in combination a platen for supporting said medium, means for successively propelling a plurality of solid projectiles in free flight toward said medium from a location spaced from said medium, means for orienting said propelling means to control the flight paths of said projectiles to impact the medium in a desired intelligible information pattern, and means for recycling said projectiles to said propelling means after they have struck the medium.

4. Apparatus for applying printing material to a medium including in combination a platen for supporting said medium, means for successively propelling a plurality of solid projectiles one by one in free flight toward said medium from a location spaced from said medium, and means for orienting said propelling means to control the respective flight paths of said projectiles to impact the medium in a desired intelligible information pattern.

5. In a ballistic printer, a gun having a barrel including a muzzle and a breech, said breech formed of resilient material and having a diameter smaller than the bore of said barrel, a magazine containing a supply of balls, means for inserting a ball from the magazine into said breech, each ball having a diameter larger than said breech, a chamber behind said breech closed by the ball in the breech, means for introducing gas under superatmospheric pressure into said chamber thus closed, means for mounting said gun for movement about two orthogonal axes, means for successively feeding another ball into said breech and dislodging the ball already there situated to permit said compressed gas to propel said ball out of said muzzle, and means for successively orienting said barrel along a predetermined line after each ball is discharged.

6. In a ballistic printer, a gun having a barrel including a muzzle and a breech, said breech formed of resilient material and having a diameter smaller than the bore of said barrel, means for mounting said gun for pivotal movement about two orthogonal axes intersecting at a point, means for orienting said gun about said point, and means for controlling said orienting means in response to predetermined signals, said orienting means including a pair of reciprocating members and a compensating cam interposed between said gun and said members.

7. In a ballistic printer, a gun, means for successively projecting balls from said gun, means for mounting said gun for movement about a fixed point, means for orienting said gun along paths adapted to describe a predetermined pattern, said orienting means including orthogonal means for applying forces to orient the gun, means for applying actuating signals to said orthogonal means, and feedback means responsive to the movement of said gun for nullifying said signals after the gun has arrived at its oriented position.

8. In a ballistic printer, a gun assembly, means for mounting the gun assembly for pivotal movement around a fixed point, a magazine for holding a supply of solid balls, means for successively feeding balls from said supply to said gun assembly for successive discharge therefrom during respective operations requiring different numbers of balls, means for successively orienting said gun assembly along predetermined paths after each ball has been discharged from said gun assembly, means for counting the number of balls discharged in an operation, and feedback means for stopping the operation upon the discharge of the last ball of the number required for each particular operation.

9. In an impact printer in which a plurality of balls are propelled in free flight across a space toward a platen, a medium adapted to produce intelligible information positioned adjacent said platen, a gun assembly having a bore and a breech of a diameter smaller than said bore, means forming a pressure chamber behind said breech, means for supplying gas under pressure to said chamber, a ball releasably held in said breech against the action of the gas pressure in said chamber, said ball having a diameter slightly greater than that of said breech to form a pneumatic seal therewith, and means for mechanically dislodging said ball from said breech while said ball is sealingly positioned to permit gas from said chamber to propel said ball along said bore out of said gun in free flight to said medium.

10. In an impact printer in which a plurality of balls are propelled in free flight across a space toward a platen, a gun assembly having a bore and a breech of a diameter smaller than said bore, means forming a pressure chamber behind said breech, means for supplying gas under pressure to said chamber, a ball having a diameter slightly greater than that of said breech releasably held in said breech against the action of the gas pressure in said chamber, and means for dislodging said ball from said breech to permit gas from said chamber to propel said ball along said bore out of said gun in free flight to said platen, said means for dislodging said ball from the breech including a magazine formed with a slot for receiving balls, a toothed element, means for mounting said toothed element for rotation with its teeth disposed in said slot, the intertooth spacing being such as to receive balls therebetween, and means for rotating said toothed element to feed balls into said breech in response to control signals.

11. In an impact printer in which a plurality of balls are propelled in free flight toward a platen, a medium adapted to produce intelligible information positioned adjacent said platen, a gun assembly having a bore and a breech of a diameter smaller than the bore, means for forming a pressure chamber behind said breech, an antechamber behind said pressure chamber, means for supplying gas under pressure to said antechamber, means providing communication between said chamber and said antechamber, a ball having a diameter slightly greater than that of said breech releasably held in said breech under the action of the pressure of said gas, said ball forming a pneumatic seal with said breech, and means for mechanically dislodging said ball from said breech while said ball is sealingly positioned to permit gas from said chamber to propel said ball along said bore and out thereof in free flight toward said medium.

12. In an impact printer in which a plurality of balls are propelled in free flight across a space toward a platen, a medium adapted to produce intelligible information positioned adjacent said platen, a gun assembly having a bore and a breech of a diameter smaller than said bore, means for forming a pressure chamber behind said breech, means for supplying gas under pressure to said chamber, a ball releasably held in said breech against the action of the pressure in said chamber, the diameter of said ball being slightly smaller than the diameter of said bore and slightly greater than that of said breech, said ball forming a pneumatic seal with said breech, and means for mechanically dislodging said ball from the breech while said ball is sealingly positioned to permit gas from said chamber to propel said ball along said bore, said gas providing a gas bearing for the dislodged ball traveling down the bore, said ball being propelled out of said gun in free flight to said medium.

13. In an impact printer in which a plurality of balls are propelled in free flight across a space toward a platen, a medium adapted to produce intelligible information positioned adjacent said platen, a gun assembly formed of resilient material having a bore and a breech, said breech being of a diameter smaller than said bore, means forming a pressure chamber behind said breech, means for supplying gas under pressure to said chamber, a ball having a diameter slightly greater than that of said breech releasably held in said breech against the action of said gas pressure in said chamber, said ball forming a pneumatic seal with said breech, and means for mechanically dislodging said ball from said breech while said ball is sealingly positioned to permit gas from the chamber to propel said ball along said bore, said bore being of a diameter slightly greater than the diameter of said ball whereby the gas propelling said ball along the bore provides a gas bearing for the same while it is traveling down the bore.

14. In a ballistic printer, a platen, a medium adapted to produce intelligible information positioned adjacent said platen, a gun having a barrel including a muzzle and a breech, said breech formed of resilient material having a diameter smaller than the bore of said barrel, means for introducing a ball into said breech, said ball and said breech being relatively dimensioned to form a pneumatic seal, means for mechanically dislodging said ball from said breech while said ball is in sealing position, and a source of gas under superatmospheric pressure for propelling said ball in free flight toward said medium.

15. In a ballistic printer, a gun having a bore, a resilient breech in said bore, said breech having a diameter which is smaller than that of said bore, means for introducing a projectile into said breech, said breech being dimensioned relative to said projectile to form a pneumatic seal therewith, and means for mechanically dislodging said projectile from its sealing position.

16. In a ballistic printer, a gun having a bore, resilient breech in said bore, said breech having a diameter which is smaller than that of said bore, means for introducing a first projectile into said breech, and means for concomitantly dislodging said first projectile from said breech and for introducing a second projectile into said breech, said first projectile being dislodged from said breech by said second projectile as it enters said breech.

17. In an impact printer in which a plurality of projectiles are propelled in free flight across a space toward a platen, a medium to produce intelligible information positioned adjacent said platen, a gun assembly having a bore and a breech of a diameter smaller than said bore, means forming a pressure chamber behind said breech, means for supplying gas under pressure to said chamber, a projectile dimensioned relative to said bore to form a pneumatic seal therewith whereby said projectile is releasably held in said breech against the action of the gas pressure in said chamber, and mechanical means for dislodging said projectile from said breech to permit gas from said chamber to propel said projectile along said bore out of said gun in free flight to said medium while forming an air bearing supporting said projectile in the course of its movement through said bore, the volume of said chamber having a predetermined relationship to that of said bore such that the number of molecules of compressed gas in said chamber is approximately equal to the number of molecules of uncompressed gas in said bore.

18. In a ballistic printer for propelling a plurality of balls toward a medium adapted to display intelligible information, a gun having a barrel formed with a bore providing a muzzle at one end thereof, an annular resilient breech at the other end of said bore, said bore having a diameter slightly greater than that of said balls, said breech having a diameter slightly less than that of said balls, means including a source of gaseous pressure located behind said breech in a direction away from said muzzle for successively urging each one of said balls into sealing engagement with said breech around the entire periphery of each ball normally to retain each ball in said sealing engagement with said breech, and means for mechanically dislodging each said ball from said breech to cause each said ball to be propelled along said bore and out of said muzzle toward said medium under the action of said gaseous pressure to form a display of intelligible information thereon.

* * * * *